US005905625A

United States Patent [19]

Schebitz

[11] Patent Number: 5,905,625

[45] Date of Patent: May 18, 1999

[54] METHOD OF OPERATING AN ELECTROMAGNETIC ACTUATOR BY AFFECTING THE COIL CURRENT DURING ARMATURE MOTION

[75] Inventor: Michael Schebitz, Eschweiler, Germany

[73] Assignee: FEV Motorentechnik GmbH & Co. KG, Aachen, Germany

[21] Appl. No.: 08/941,648

[22] Filed: Sep. 30, 1997

[30] Foreign Application Priority Data

Oct. 2, 1996 [DE] Germany ..... 196 40 659

[51] Int. Cl.[6] ..... H01H 47/04

[52] U.S. Cl. ..... 361/154; 361/160

[58] Field of Search ..... 361/152–156, 361/160

[56] References Cited

U.S. PATENT DOCUMENTS

| | | | |
|---|---|---|---|
| 3,725,747 | 4/1973 | Cowan | 361/154 |
| 3,778,697 | 12/1973 | Link et al. | 361/156 |
| 4,434,450 | 2/1984 | Gareis | 361/152 |
| 4,455,543 | 6/1984 | Pischinger et al. . | |
| 4,833,565 | 5/1989 | Bauer et al. | 361/154 |
| 4,922,878 | 5/1990 | Shinogle et al. | 361/154 |
| 5,128,825 | 7/1992 | Hurley et al. | 361/154 |
| 5,287,243 | 2/1994 | Hu | 361/152 |
| 5,546,268 | 8/1996 | Hurley et al. | 361/154 |

FOREIGN PATENT DOCUMENTS

| | | | |
|---|---|---|---|
| 130081 | 3/1978 | German Dem. Rep. | 361/194 |

*Primary Examiner*—Fritz Fleming
*Attorney, Agent, or Firm*—Venable; Gabor J. Kelemen

[57] ABSTRACT

A method of operating an electromagnetic actuator having an electromagnet provided with a pole face, an armature movable towards and away from the pole face and a resetting spring exerting on the armature a resetting force urging the armature away from the pole face, includes the steps of supplying current to the electromagnet for generating an electromagnetic force moving the armature towards the pole face against the resetting force; and controlling the current supplying step such that at least along a terminal portion of the displacement path of the armature during its approach toward said pole face, the force/time curve of the magnetic force extends substantially parallel to and lies above the force/displacement spring curve of the resetting spring.

6 Claims, 5 Drawing Sheets

METHOD OF OPERATING AN ELECTROMAGNETIC ACTUATOR BY AFFECTING THE COIL CURRENT DURING ARMATURE MOTION

CROSS REFERENCE TO RELATED APPLICATION

This application claims the priority of German Application No. 196 40 659.5 filed Oct. 2, 1996, which is incorporated herein by reference.

BACKGROUND OF THE INVENTION

Electromagnetically operated actuators have at least one electromagnet and an armature which exerts a force on a setting member and which is coupled with at least one resetting element so that the armature may be moved by applying current to the coil of the electromagnet from a first position predetermined by the resetting element, into a second position defined by the abutting relationship of the armature at the electromagnet. Electromagnetically operated actuators are used, for example, for controlling the cylinder valves in piston-type internal-combustion engines. The armature is attached to the engine valve, and the actuator has two electromagnets between which the armature may be moved against the force of a resetting arrangement by switching off the coil current of the holding electromagnet and applying coil current to the capturing electromagnet. By virtue of a suitable actuation of the individual actuators of the cylinder valves an inflow and outflow of the work medium may be achieved so that the work process can be optimally affected dependent on the respective necessary considerations.

The course of the control has a significant effect on the different parameters, for example, the conditions of the work medium in the intake zone, in the work chamber and in the exhaust zone as well as on the events in the work chamber itself. Since piston-type internal-combustion engines operate in a non-stationary manner under widely different operational conditions, a suitable, adaptable control of the cylinder valves is necessary. Electromagnetically operated actuators for cylinder valves are described, for example, in U.S. Pat. No. 4,455,543.

A significant problem in the control of electromagnetically operated actuators of the above type is the timing accuracy which is required particularly for the intake valves in the control of the engine output. An accurate time control is rendered difficult by the manufacturing tolerances, the wear phenomena appearing during operation as well as the various operational conditions, for example, alternating load requirements and alternating operating frequencies, because these external influences may affect time-relevant parameters of the system.

A measure for achieving a high control accuracy consists of applying a relatively high energy for capturing the armature at a magnet pole face. Such a high energy input, however, involves a lowering of the operational reliability because when high energy is used, the problem of armature rebound is encountered in a more pronounced manner. Such a problem is caused by the fact that the armature impacts with a high speed on the pole face and rebounds therefrom immediately or after a short delay. These rebound phenomena appearing in the cylinder valve control adversely affect the operation of the engine.

In the earlier-mentioned known electromagnetic actuator, coil springs having approximately linear spring characteristics are used as resetting springs. The magnets of this arrangement, however, have an exponential force characteristic as a function of the armature displacement which has the result that the magnetic force, in case of a significant distance of the armature from the pole face, may be less than the spring force applied to the armature in that position. Further, as the armature approaches the pole face, both forces are approximately equal and upon further approach of the armature towards the pole face, the magnetic force will become significantly greater than the counteracting spring force. Such an excessive magnetic force towards the end of the armature motion results in an acceleration of the armature and thus an increase of the armature speed which has an adverse effect when the armature impinges on the pole face. In addition to an increased wear and a higher noise generation, there is thus encountered the earlier-mentioned further problem of the armature rebound.

SUMMARY OF THE INVENTION

It is an object of the invention to provide an improved method of controlling the current supply to electromagnets of an electromagnetic actuator, to eliminate, for all practical purposes, the disadvantages discussed above.

This object and others to become apparent as the specification progresses, are accomplished by the invention, according to which, briefly stated, the method of operating an electromagnetic actuator having an electromagnet provided with a pole face, an armature movable towards and away from the pole face and a resetting spring exerting on the armature a resetting force urging the armature away from the pole face, includes the steps of supplying current to the electromagnet for generating an electromagnetic force moving the armature towards the pole face against the resetting force; and controlling the current supplying step such that at least along a terminal portion of the displacement path of the armature during its approach toward said pole face, the force/time curve of the magnetic force extends substantially parallel to and lies above the force/displacement spring curve of the resetting spring.

The above-outlined measure according to the invention may limit the excessive force of the electromagnet relative to the counteracting force of the return spring, whereby the impact speed of the armature on the pole face is reduced to a desired magnitude. The invention thus has the advantage that a secure capturing of the armature by the electromagnet is achieved while a partial or full rebound of the armature from the pole face is prevented.

According to an advantageous feature of the invention, the coil current is first maintained at a predetermined value $I_{max}$ during a predetermined period $T_A \geqq 0$ and thereafter, from a moment $t_A$, the coil current decreases proportionately to the course of the spring characteristic and from or after the expected moment $t_B$ of an impact of the armature on the pole face the current is reduced to the magnitude of the holding current $I_H$. Such method is particularly of significance for electromagnetic actuators having two spaced electromagnets between which the armature, connected to the setting member, such as a cylinder valve, is moved back and forth against the force of resetting springs. Such a reciprocating motion is caused by the fact that the armature which in one switching position lies against one electromagnet, is, after switching off the holding current at that electromagnet, urged by the force of the return spring, accelerated in the direction of the other electromagnet so that the armature arrives into the force field of the capturing electromagnet energized by the high capturing current $I_{max}$ and impacts on the pole face of the capturing electromagnet. The armature lying against the pole face is thereafter held by a reduced holding current $I_H$ which, for reducing the energy input, may be cycled between an upper and a lower threshold value. Between the current supply to the magnet coil with the high capturing current $I_{max}$ and the current supply with the low holding current $I_H$ as the armature approaches, that is, before it impinges on the pole face, the current supply is reduced in such a manner that a force curve of the magnetic force is obtained which in this region is approximately proportional to the course of the force curve of the resetting spring.

According to a further advantageous feature of the invention, the course of the current supply during one switching cycle is at least periodically detected as an actual value and is compared with a predetermined current course as a desired value and in case of deviations, the current is accordingly adjusted for the successive switching cycles. Dependent on the particular application, such a desired value/actual value comparison may be performed for each switching cycle or for a predetermined constant number or a variable number of switching cycles. The variable number of switching cycles may depend on operational conditions.

DESCRIPTION OF THE PREFERRED EMBODIMENT

Figure 1:
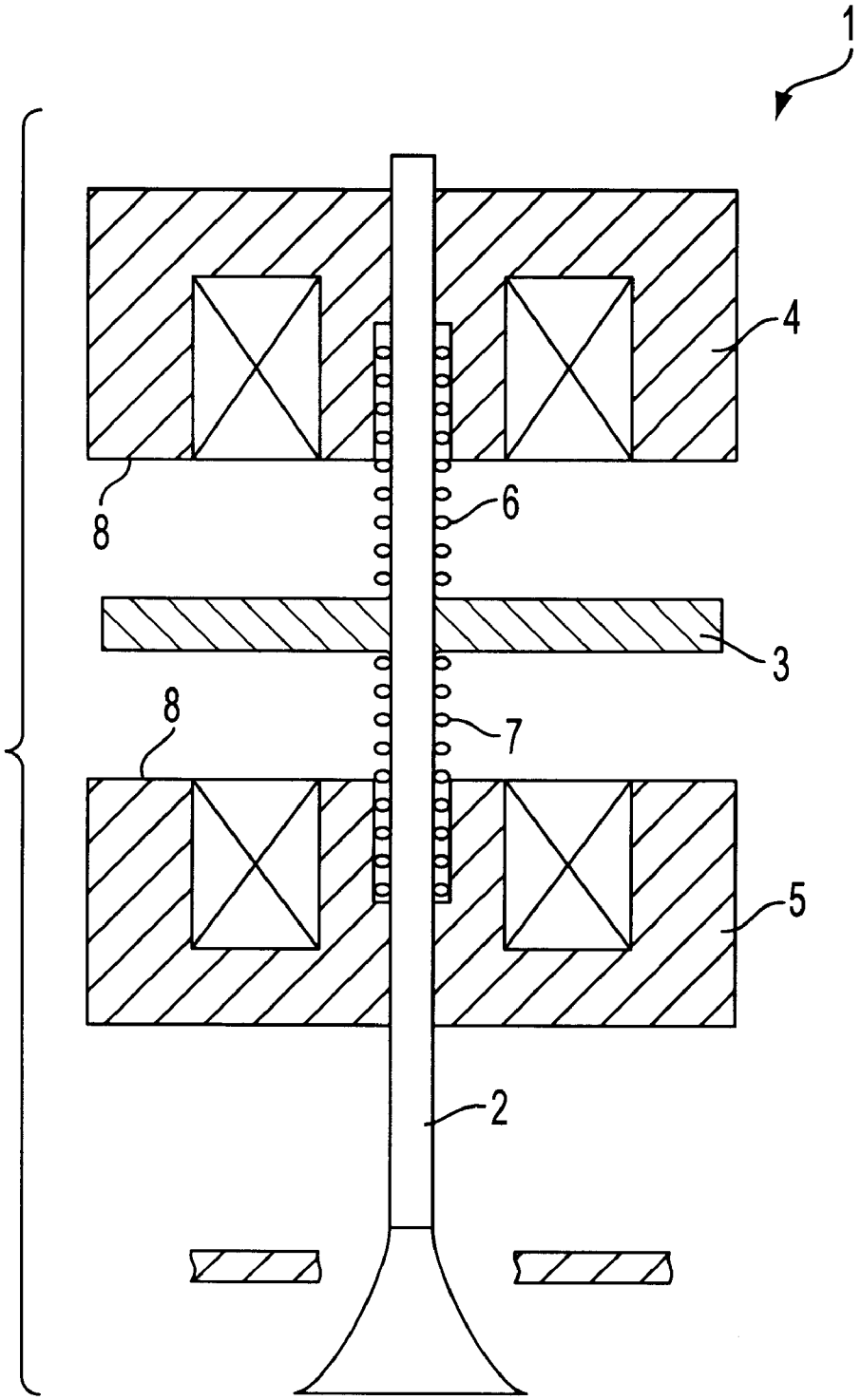
FIG. 1 is a schematic, axial sectional view of an electromagnetic actuator for operating a cylinder valve.

FIG. 1 schematically illustrates an electromagnetic actuator 1 which includes an armature 3 attached to a cylinder valve 2, a closing magnet 4 and an opening magnet 5. The armature 3 is, by means of resetting springs 6 and 7, maintained in the deenergized state of the electromagnets 4 and 5 in a position of rest therebetween. The distance of the armature 3 in its position of rest from the pole face 8 of the respective electromagnets 4 and 5 depends on the design of the springs 6 and 7. In the illustrated embodiment the two springs 6 and 7 are of identical design so that the position of rest of the armature 3 is in the middle between the two pole faces 8 as shown in FIG. 1. Thus, in the closed position the armature 3 lies against the pole face 8 of the closing magnet 4.

For operating the cylinder valve 2, that is, for initiating a motion from the closed position into the open position, the holding current flowing through the coil of the closing magnet 4 is switched off. As a result, the holding force of the closing magnet 4 drops below the force of the return spring 6 and thus the armature 3 starts its motion, accelerated by the force of the compressed return spring 6. After passing through its position of rest, the "flight" of the armature 3 is braked by the force of the progressively compressed return spring 7 associated with the opening magnet 5. To ensure that the armature 3 is captured and held in the open valve position, the coil of the opening magnet 5 is supplied with current. For closing the cylinder valve 2, the switching and motion events occur in a reverse sequence.

Figure 2:
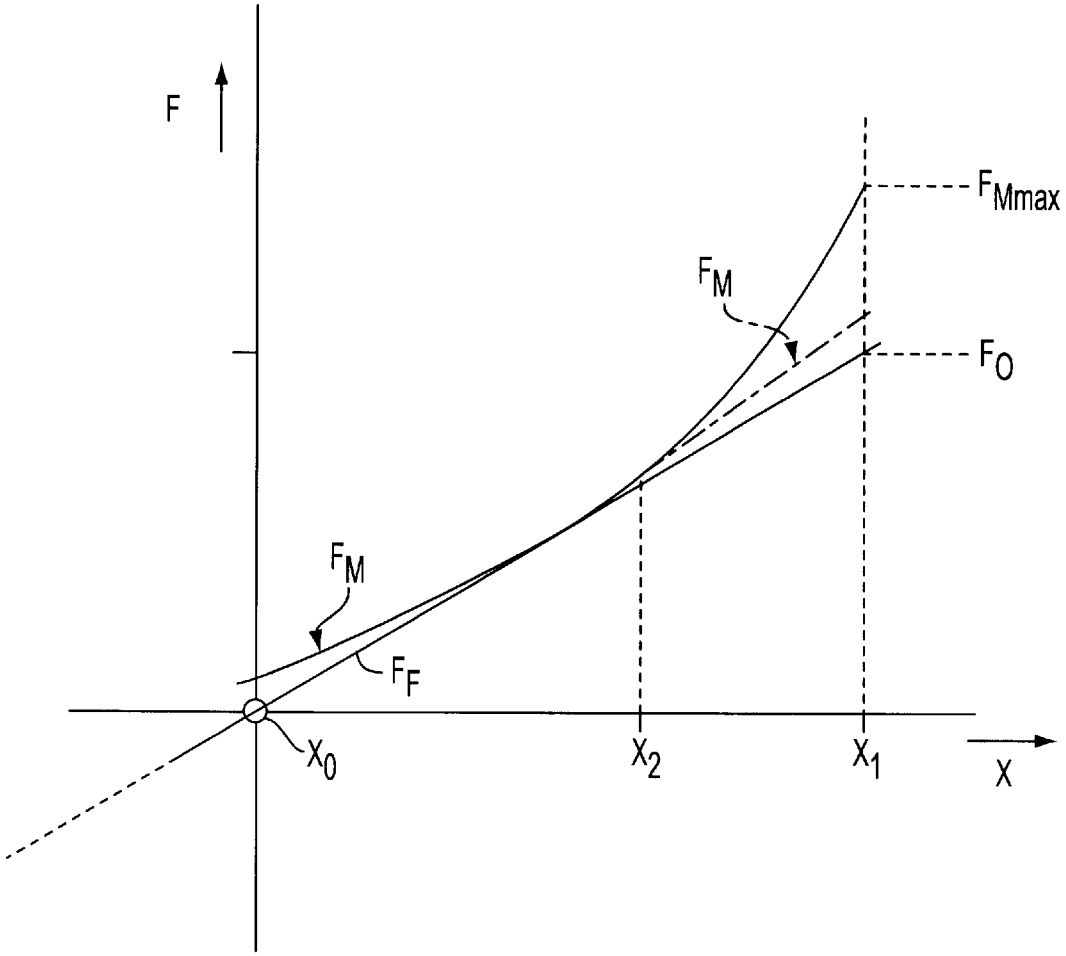
FIG. 2 is a diagram illustrating the force of a return spring and an electromagnet acting on the armature as a function of the armature displacement.

FIG. 2 illustrates the course of the magnet force $F_M$ affecting the armature 3, for example, the magnet force of the opening magnet 5 as a function of the distance of the armature 3 to the pole face 8 of the magnet 5. The associated resetting spring 7 which acts against the magnetic force exerted by the electromagnet 5 is, in the illustrated embodiment, of linear design as it may be seen from the course of the spring force curve $F_F$. The point of intersection $X_0$ shows the middle position of the armature 3 in case of a de-energized holding magnet, while the point $X_1$ corresponds to the end position of the armature 3 at the pole face 8 of the opening magnet 5, corresponding to the earlier-described working position.

It is assumed that the spring force to be applied to the armature 3 in its end position $X_1$ is $F_0$. The magnet force $F_M$ opposes the spring force $F_F$ and increases quadratically as the distance between the armature and the respective pole face decreases. To ensure that the armature 3 is reliably attracted during its motion, the capturing current must be selected to be of such a larger value that the course of the magnet force $F_M$ lies, at least from a point of armature motion between $X_0$ and $X_1$, above the associated resetting force $F_F$ in which the kinetic energy was stored in the spring as potential energy. This results in a corresponding excess of the magnetic force $F_M$ precisely shortly before the impingement of the armature 3 on the respective pole face, that is, at $X_1$. With a correspondingly increasing acceleration, the speed of the armature motion also increases.

To avoid an excessive force, as the armature approaches the pole face, the current supply to the capturing electromagnet is reduced. This may start, for example, when both curves $F_F$ and $F_M$ are closest to one another, for example, when the armature 3 has reached the position $X_2$. By means of the reduction of the current supply to the capturing electromagnet 5 which will be described in further detail later, the magnetic force is continuously reduced so that, while taking into consideration the diminishing distance of the armature 3 from the pole face 8, an increase of the magnet force $F_{M1}$ is obtained such that the magnet force curve extends approximately parallel to and above the spring force curve $F_F$, as shown in dash-dot lines in FIG. 2.

Figures 3A, 3B:
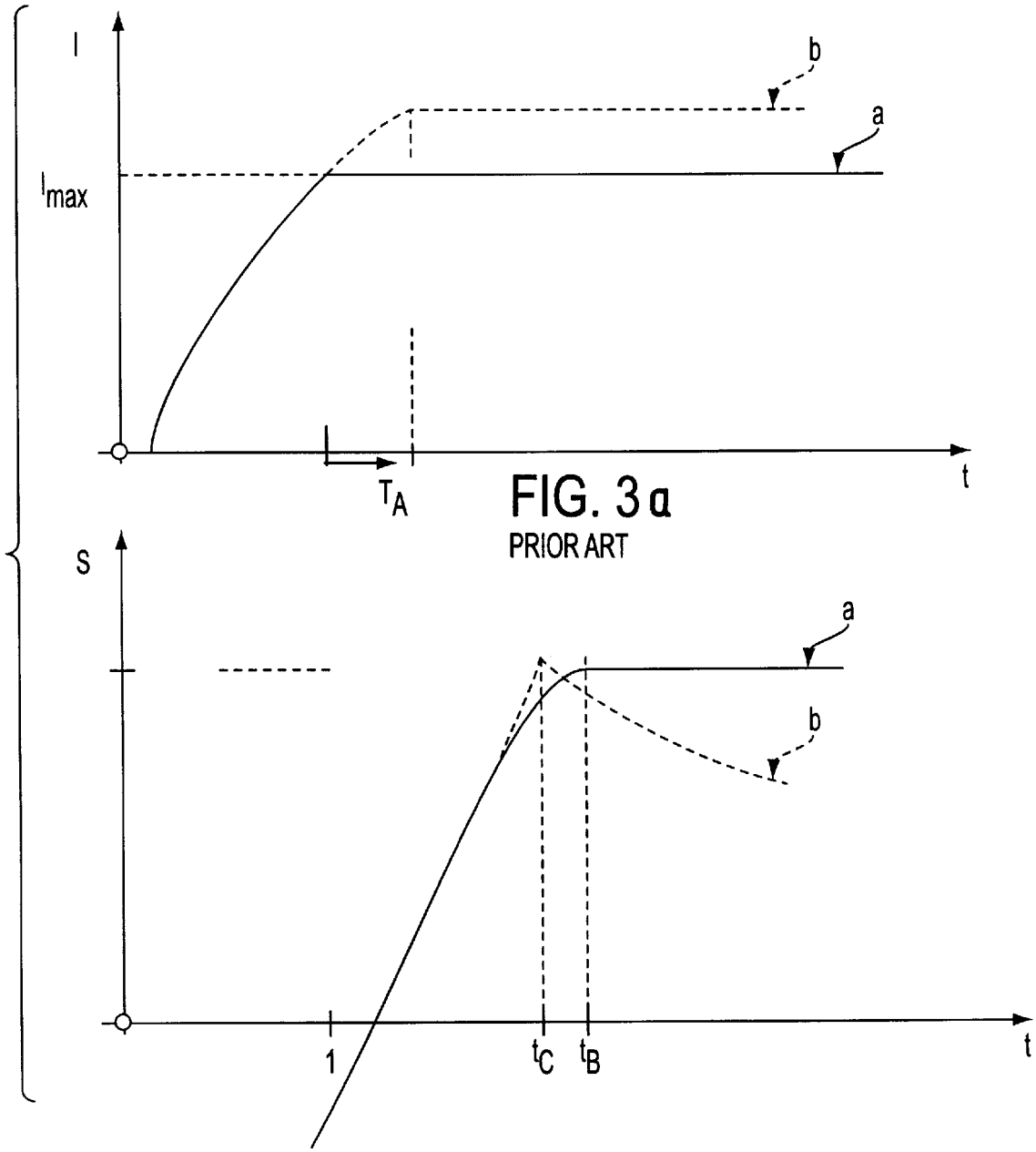
FIG. 3a PRIOR ART
FIG. 3b PRIOR ART
FIG. 3*a* is a diagram illustrating the course of the armature current as a function of time during a conventional control of the capturing current.
FIG. 3*b* is a diagram illustrating the course of the armature displacement as a function of time during a conventional control of the capturing current.

FIG. 3*a* and 3*b* illustrate the coil current and armature displacement for two different current intensities according to a conventional current control process. In FIG. 3*a* curve a shows a current curve at the capturing electromagnet of a normally operating electromagnetic setting device. The current is increased to $I_{max}$ after starting the current flow and then it is maintained constant at that value for a predetermined period to ensure a capture of the armature. As illustrated FIG. 3*b* in the displacement/time diagram for the armature motion, the armature reaches the magnet pole face at the moment $t_B$ and remains permanently at that position. Such a condition is shown by the curve a of the displacement/time diagram.

If the coil of the capturing electromagnet, that is, in the described embodiment the opening magnet 5, receives excessive energy, that is, the coil current is too high, as shown for curve b in the current/time diagram of FIG. 3*a,* then the armature receives excessive kinetic energy so that the armature, based on its high speed of motion, after impinging on the magnet pole face at moment $t_c$, rebounds and, dependent on the magnitude of the impact speed, is caught with a delay, if at all. In the displacement/time diagram for the armature motion in FIG. 3*b*, this is illustrated by the curve b in which the successive motion of the armature (a rebound with a subsequent capture or a complete rebound) is not illustrated.

Figure 4:
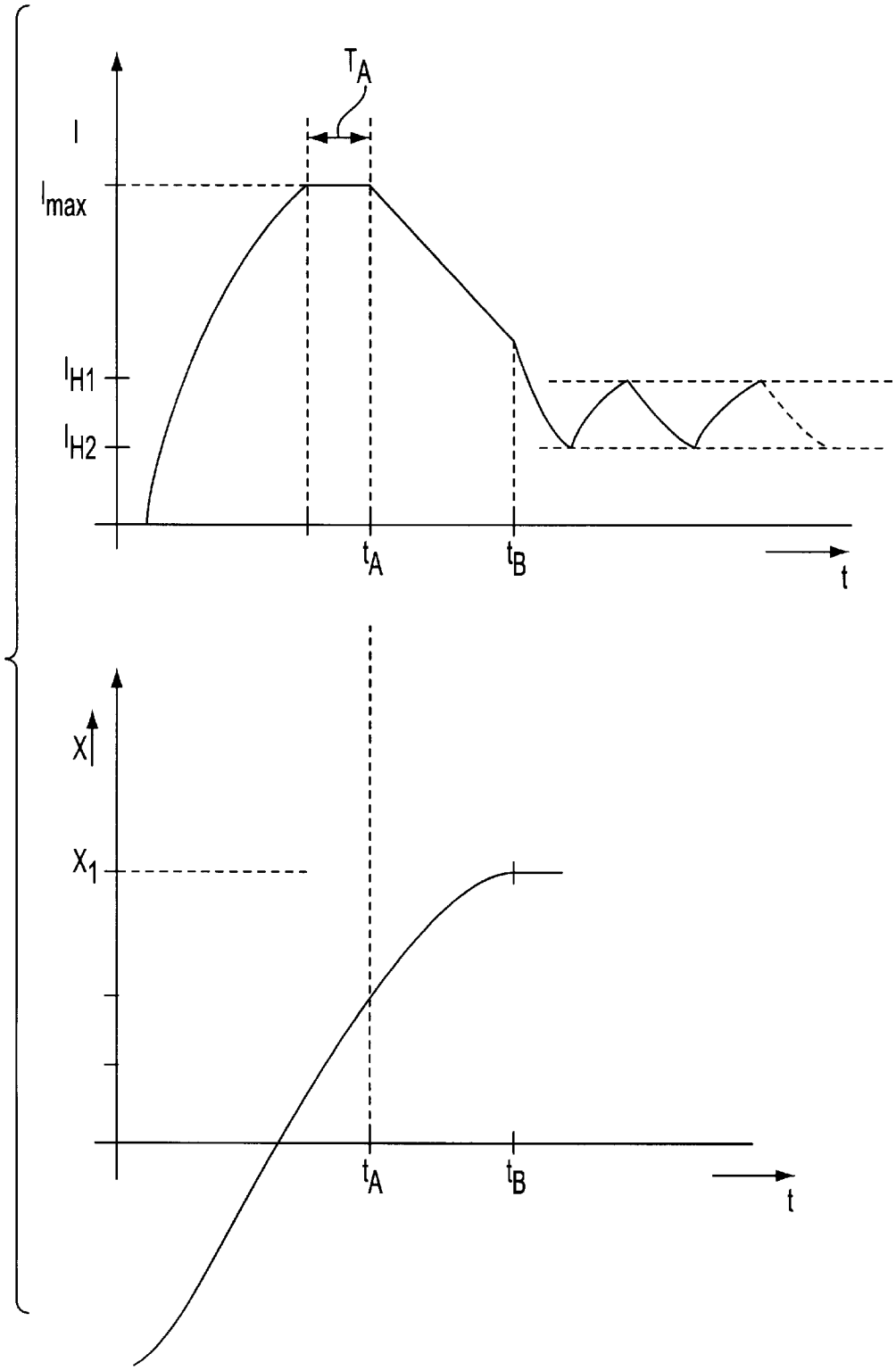
FIG. 4 is a diagram of the course of the coil current (upper graph) and the armature displacement (lower graph) as a function of time with a current supply control according to the method of the invention.

Turning to FIG. 4, in the upper diagram a current course (current/time curve) obtained by the method according to the invention is shown, while in the lower diagram the displacement/time curve of the armature displacement is illustrated. Here too, first the current is increased to a predetermined capturing current magnitude $I_{max}$ which is maintained constant at that magnitude for a predetermined period $T_A$. From a predeterminable moment $t_A$ shortly after the armature 3, as it moves away from the closing magnet 4 towards the opening magnet 5, passes through the zero position or at a correspondingly later moment, the generated magnetic force at the capturing electromagnet is continuously reduced by reducing the capturing current such that the course of the magnetic force acting on the approaching armature 3 corresponds approximately to the increasing force of the counteracting force of the resetting spring 7. The current supply, however, has to be controlled such that the magnetic force is always greater than the spring force as shown in FIG. 2 for the curve portion $F_{M1}$.

At the moment $t_B$ the armature abuts against the pole face 8 of the capturing opening magnet 5 and is maintained there by a holding current $I_H$ which, for purposes of energy saving, is cycled between a lower threshold value $I_{H2}$ and an upper threshold value $I_{H1}$.

Dependent upon the course of the current reduction, the magnitude of the capturing current in the regulated phase may lie above the magnitude $I_H$ before the impact moment $t_B$so that before that moment the current supply is first completely shut off and is turned on only upon reaching of the value for the holding current $I_H$, or in case of a cycled holding current, the value of the lower threshold magnitude $I_{H2}$.

Since in practice it is very difficult to manufacture resetting springs which have spring characteristics that take into account the desired actual operational conditions, the method according to the invention adapts the course of the magnet force to a given spring characteristic curve during the armature displacement and also affects the desired motion course and motion velocity. In addition to an adaptation to a linear spring characteristic by affecting the current supply to the momentary capturing magnet, it is also feasible to provide a magnet force with an arbitrarily designed characteristic curve such as a progressive-digressive curve. In such a case, after an initial acceleration of the armature, the braking effect of the increasing force of the resetting spring will become noticeable due to the reduction of the magnet force as the armature approaches the pole face.

The spring characteristic curve of the respective resetting spring remains practically unchanged even after a long service because, for example, compression coil springs are not exposed to any "wear". In the described example of an electromagnetic actuator for a cylinder valve, however, the motion of the armature is not constant in time, but is changed by a wide variety of effects: for example, the conditions of the work medium in the intake zone, in the work chamber and in the exhaust zone as well as the processes in the work chamber itself such as, for example, the counter pressure in the work chamber exerted on the intake or exhaust valve. Since such piston-type internal-combustion engines operate in a non-stationary manner under widely different operational conditions, these conditions may be taken into account by influencing the slope of the current reduction in the regulated phase between moments $t_A$ and $t_B$ (FIG. 4).

Thus, for performing the method according to the invention, in a suitable control device the desired control course for the capturing current is stored in the form of a curve assembly representing the widely varying operational conditions and then the actual course is compared with the desired course preset by the control device and in case of deviations the actual course is accordingly adjusted for the consecutive switching (operating) cycles. Such a desired value/actual value comparison may be performed continuously for each switching cycle or may be effected periodically after a selected number of switching cycles. The number of switching cycles may be changed by the engine control based on operational conditions.

Figure 5:
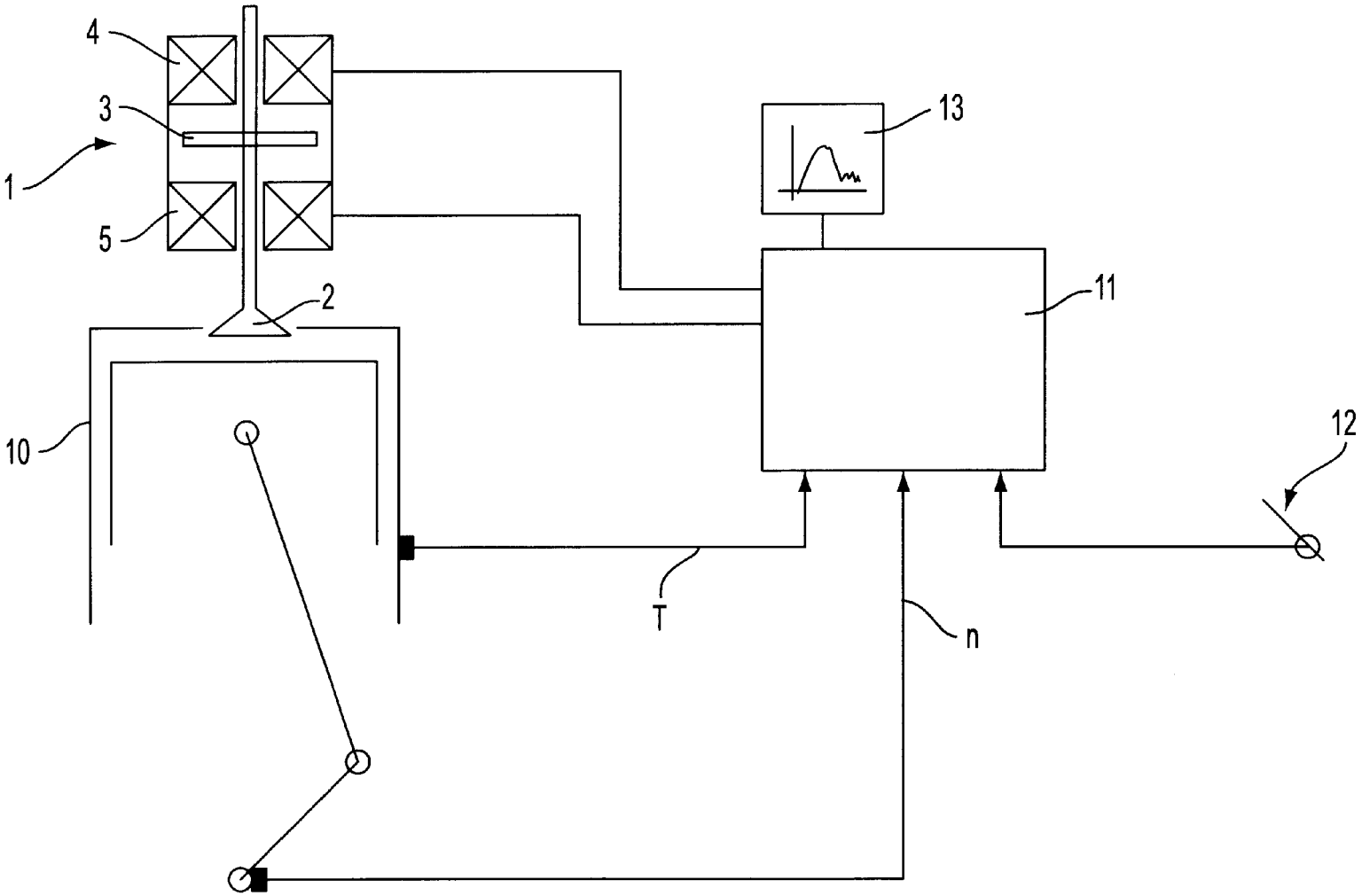
FIG. 5 is a block diagram of a control system for an electromagnetic actuator for a cylinder valve.

FIG. 5 shows a block diagram of a system for controlling an electromagnetic actuator 1 as shown in FIG. 1. The system serves for operating a cylinder valve 2 of a cylinder 10 forming part of a reciprocating-type internal-combustion engine. The electromagnets 4 and 5 of the actuator 1 are controlled by a control and current supply device 11 of the engine and are correspondingly supplied with current during the predetermined work cycles.

For actuating the individual electromagnetic actuators of the cylinder valves, the load desired by the driver is applied to the electronic control device 11 by means of a gas pedal 12, and further operational parameters are applied to the control device 11 by means of suitable signal transmitters, such as the engine rpm n, the engine temperature $\tau$ and, dependent upon the "comfort level" of the control device, further operation-relevant parameters such as intake pipe pressure, etc. are applied.

While it is in principle possible to apply in a constant manner the change of the current supply to the capturing electromagnet for adapting the current to the course of the spring characteristic, it is feasible for a suitably composed electronic control device to compare the current flow, during energization of the respective capturing holding magnet, with a predetermined desired value for the current course and to make corrections in case of deviations. As noted earlier, after a longer service life the force relationship between the resetting spring on the one hand and the magnet force on the other hand may change relative to the original setting of the armature in favor of the magnet force because of wear or temperature changes, changes of the lubricant viscosities, etc. so that the armature impacts on the pole of the momentarily capturing electromagnet with a higher impact speed than desired. Since the system is of the electrodynamic type and a change of the motion velocity of the armature makes itself noticeable in the current course, by detecting the actual value of the current course and by a comparison with a predetermined desired value (illustrated by a separate desired value/actual value comparator 13 of the electronic control device 11) upon determining a deviation, the current supply may be adjusted both in the magnitude of the capturing current $I_{max}$ to be predetermined and in connection with the change during the capturing phase between $t_A$ and $t_B$.

Instead of a fixed desired value inputted in the desired value/actual value comparator 13, it is feasible to input a desired value curve assembly which, as a function of the momentary operating point, may be utilized within the framework of the control device 11 for the desired value/actual value comparison.

It will be understood that the above description of the present invention is susceptible to various modifications, changes and adaptations, and the same are intended to be comprehended within the meaning and range of equivalents of the appended claims.

What is claimed is:

1. A method of operating an electromagnetic actuator having at least one electromagnet provided with a pole face, an armature movable towards and away from the pole face and at least one resetting spring exerting on the armature a resetting force urging the armature away from said pole face; said resetting spring having a force/displacement spring curve; the method comprising the steps of (a) supplying current to said electromagnet for generating an electromagnetic force moving said armature towards said pole face against said resetting force; and (b) controlling the current supplying step such that at least along a terminal portion of the displacement path of the armature during its approach toward said pole face, the force/time curve of the magnetic force extends substantially parallel to and lies above said spring curve; said controlling step including (1) after starting the supplying step, maintaining constant the current at a predetermined maximum magnitude for a predeterminable period;

(2) after said period, reducing the current from said maximum magnitude proportionately to said spring curve; and (3) starting from an expected moment of impact of the armature on the pole face, reducing the current to a magnitude corresponding to a holding current for maintaining said armature in engagement with said pole face.

2. The method as defined in claim 1, wherein step (c) (2) includes the step of reducing the current until the expected moment of impact of the armature on the pole face.

3. The method as defined in claim 1, wherein step (c) (2) includes the step of reducing the current in constant amounts.

4. The method as defined in claim 1, wherein step (c) (3) includes the step of cycling the holding current between a lower threshold value and an upper threshold value.

5. The method as defined in claim 1, further comprising the step of (c) detecting the current/time course of the current supply in one operational cycle as an actual value;

(d) comparing the actual value with a predetermined desired value; and (e) altering the current supply for subsequent operational cycles as a function of deviations between said actual and desired values.

6. A method of operating an electromagnetic actuator having at least one electromagnet provided with a pole face, an armature movable towards and away from said pole face and at least one resetting spring exerting on the armature a resetting force urging the armature away from the pole face; said resetting spring having a force/displacement spring curve; the method comprising the steps of (a) supplying current to said electromagnet for generating an electromagnetic force moving said armature towards said pole face against said resetting force;

(b) controlling the current supplying step such that at least along a terminal portion of the displacement path of the armature during its approach toward said pole face, the force/time curve of the magnetic force extends substantially parallel to and lies above said spring curve;

(c) detecting the current/time course of the current supply in one operational cycle as an actual value;

(d) comparing the actual value with a predetermined desired value; and (e) altering the current supply for subsequent operational cycles as a function of deviations between said actual and desired values.

* * * * *